US011737612B2

(12) United States Patent
Ahmed

(10) Patent No.: US 11,737,612 B2
(45) Date of Patent: Aug. 29, 2023

(54) TISSUE BOX COVERING APPARATUS

(71) Applicant: Tariq Ahmed, San Jose, CA (US)

(72) Inventor: Tariq Ahmed, San Jose, CA (US)

( * ) Notice: Subject to any disclaimer, the term of this patent is extended or adjusted under 35 U.S.C. 154(b) by 0 days.

(21) Appl. No.: 17/240,842

(22) Filed: Apr. 26, 2021

(65) Prior Publication Data

US 2021/0330141 A1 Oct. 28, 2021

Related U.S. Application Data

(60) Provisional application No. 63/016,059, filed on Apr. 27, 2020.

(51) Int. Cl.
*A47K 10/18* (2006.01)

(52) U.S. Cl.
CPC ..... *A47K 10/185* (2013.01)

(58) Field of Classification Search
CPC ..... A47K 10/16; A47K 10/18; A47K 10/185; A47K 10/20; A47K 10/025; Y10S 248/905; B60R 7/084
USPC ..... 248/311.2, 905, 300, 146, 147, 150, 152
See application file for complete search history.

(56) References Cited

U.S. PATENT DOCUMENTS 1,294,563 A * 2/1919 Stone ..... A61J 19/06 248/311.2
2,537,050 A * 1/1951 Gluck ..... A47K 10/426 248/905
2,576,526 A * 11/1951 Marchand ..... A47K 10/22 220/477
2,882,113 A * 4/1959 Gantner ..... A47K 10/426 248/905
2,990,950 A * 7/1961 Alexander ..... B65D 5/4208 221/45
3,489,385 A * 1/1970 Dill, Jr. ..... A47K 10/185 248/905
4,491,231 A * 1/1985 Heggeland ..... B65D 21/02 206/509
4,498,598 A * 2/1985 Bae ..... B65D 7/26 217/14

(Continued)

OTHER PUBLICATIONS

Nuo-Z, Strang Magnetic Car Tissue Box, Car Sun Visor Tissue Bag Storage Handy Paper Napkin Holder Clip, amazon.com.

(Continued)

*Primary Examiner* — Christopher Garft
*Assistant Examiner* — Michael McDuffie
(74) *Attorney, Agent, or Firm* — Bold IP, PLLC

(57) ABSTRACT

The tissue box cover is an apparatus that helps prevent contaminants such as dust, bacteria, germs, droplets, allergens and viruses that may be spread by sneezing, coughing, talking of people and pets from intruding into the tissue box. The apparatus prevents the tissue box from physical damage and waste of the issues if the tissue box breaks, by providing a protective covering. Further, the apparatus includes a plurality of folding edges that enables a folding configuration for the tissue box cover, for ease of packaging, display, storage and transport. Furthermore, the lid of the apparatus is removably attached, such that the lid may be removed when replacing the tissue box or when the box is stored in a folded configuration. Additionally, a plurality of fasteners mounted between the lid and the box cover, provides secure covering as well as easy fastening and unfastening of the lid to the box cover.

20 Claims, 9 Drawing Sheets

(56) References Cited

U.S. PATENT DOCUMENTS

| | | | | | |
|---|---|---|---|---|---|
| 4,508,237 | A * | 4/1985 | Kreeger | B65D 11/182 | 206/509 |
| 4,967,988 | A * | 11/1990 | Nguyen | B60R 7/084 | 248/905 |
| 5,332,138 | A * | 7/1994 | Gross | B60R 7/084 | 224/543 |
| 5,531,325 | A * | 7/1996 | Deflander | B65D 77/06 | 221/64 |
| 5,540,354 | A * | 7/1996 | Annand | A47K 10/423 | 206/449 |
| 7,089,627 | B2 | 8/2006 | Seidler | | |
| 8,141,562 | B2 | 3/2012 | Prague | | |
| 9,561,681 | B2 * | 2/2017 | Magley | B42D 15/042 | |
| 10,759,616 | B2 * | 9/2020 | Tran | B65H 1/08 | |
| 2001/0052477 | A1 * | 12/2001 | McNeill | B65D 77/0446 | 206/459.5 |
| 2004/0099623 | A1 * | 5/2004 | Kurtz | A47K 10/20 | 248/905 |
| 2005/0194384 | A1 | 9/2005 | Petit | | |
| 2006/0175222 | A1 * | 8/2006 | Holland | A47K 10/185 | 206/494 |
| 2007/0007416 | A1 * | 1/2007 | Vogel | A47F 5/112 | 248/311.2 |
| 2011/0240670 | A1 * | 10/2011 | Coleman | A47K 10/185 | 221/46 |
| 2021/0261289 | A1 * | 8/2021 | Yasui | B65D 83/0805 | |

OTHER PUBLICATIONS

Banchelle, Banchelle Car Tissue Holder, Hanging Paper Towel Clip, PU Leather Tissue Box, Paper Carton, Paper Towel Box (Beige), amazon.com.

Nuo-Z, Strang Magnetic Car Tissue Box, Car Sun Visor Tissue Bag Storage Handy Paper Napkin Holder Clip, amazon.com. [Current link no longer available. Not able to access].

Banchelle, Banchelle Car Tissue Holder, Hanging Paper Towel Clip, PU Leather Tissue Box, Paper Carton, Paper Towel Box (Beige), amazon.com. https://www.amazon.com/BANCHELLE-Tissue-Holder-Hanging-Leather/dp/B07RKPPQST/ref=sr_1_1?crid=2VGHNV62YWC2N&keywords=BANCHELLE%2C+Banchelle+Car+Tissue+Holder%?C+Hanging+Paper+Towel+Clip&qid=1686166269&sprefix=banchelle%2C+banchelle+car+tissue+holder%2C+hanging+paper+towel+clip%2Caps%2C368&sr=8-1 [Date accessed: May 31, 2023].

* cited by examiner

TISSUE BOX COVERING APPARATUS

The current application claims a priority to the U.S. Provisional Patent application Ser. No. 63/016,059 filed on Apr. 27, 2020.

FIELD OF THE INVENTION

The present invention generally relates to a tissue box cover. More specifically, the present invention relates to a tissue box cover with a lid that helps prevent foreign particles such as dust, bacteria, germs, allergens, droplets, and viruses from entering a tissue box and contaminating the tissues. It will also prevent the tissue box from physical damage and waste of the issues if the tissue box breaks by providing a protective layer on top of the tissue box.

BACKGROUND OF THE INVENTION

Tissues are a commonly used items from homes and offices to hospitals and restaurants. Many users also keep tissue boxes in their vehicle. Tissues often come in boxes that are easily stored and placed to conveniently dispense a single tissue at a time but are frequently exposed to particles in the air that may contaminate the entire supply. Though there exists many tissue box covers today, they are used for more aesthetic reasons than to protect the tissues that a user will use to clean their face. These covers do not provide the protection needed to help limit the spread of disease particularly in a vehicle where frequent acceleration can cause the tissues to fall onto the floor, collecting germs and dirt. Some of these covers may also be rigid which makes it harder to package and transport large quantities and prevents retailers from keeping larger quantities of it due to a large shelf space requirement to carry them in the store.

An objective of the present design is to provide the user with a tissue box cover that helps prevent contaminants such as dust, bacteria, germs, droplets, allergens and viruses that may be spread by sneezing, coughing, talking of people and pets from intruding into the box. Further, the present invention comprises a plurality of folding edges that enables a foldable configuration for the tissue box cover, thereby enabling ease of display, storage, packaging and transport. Furthermore, the lid of the present invention is removably attached, such that the lid may be removed when replacing the tissue box or when the box cover is stored in a folded configuration. The lid comprises a rim that sits flush against the opening of the cover to prevent both solids and liquids from entering and contaminating the tissues. Additionally, a plurality of fasteners mounted between the lid and the box cover provides a secure covering as well as enables users to easily fasten and unfasten the lid to the box cover.

DETAIL DESCRIPTIONS OF THE INVENTION

Figure 1:
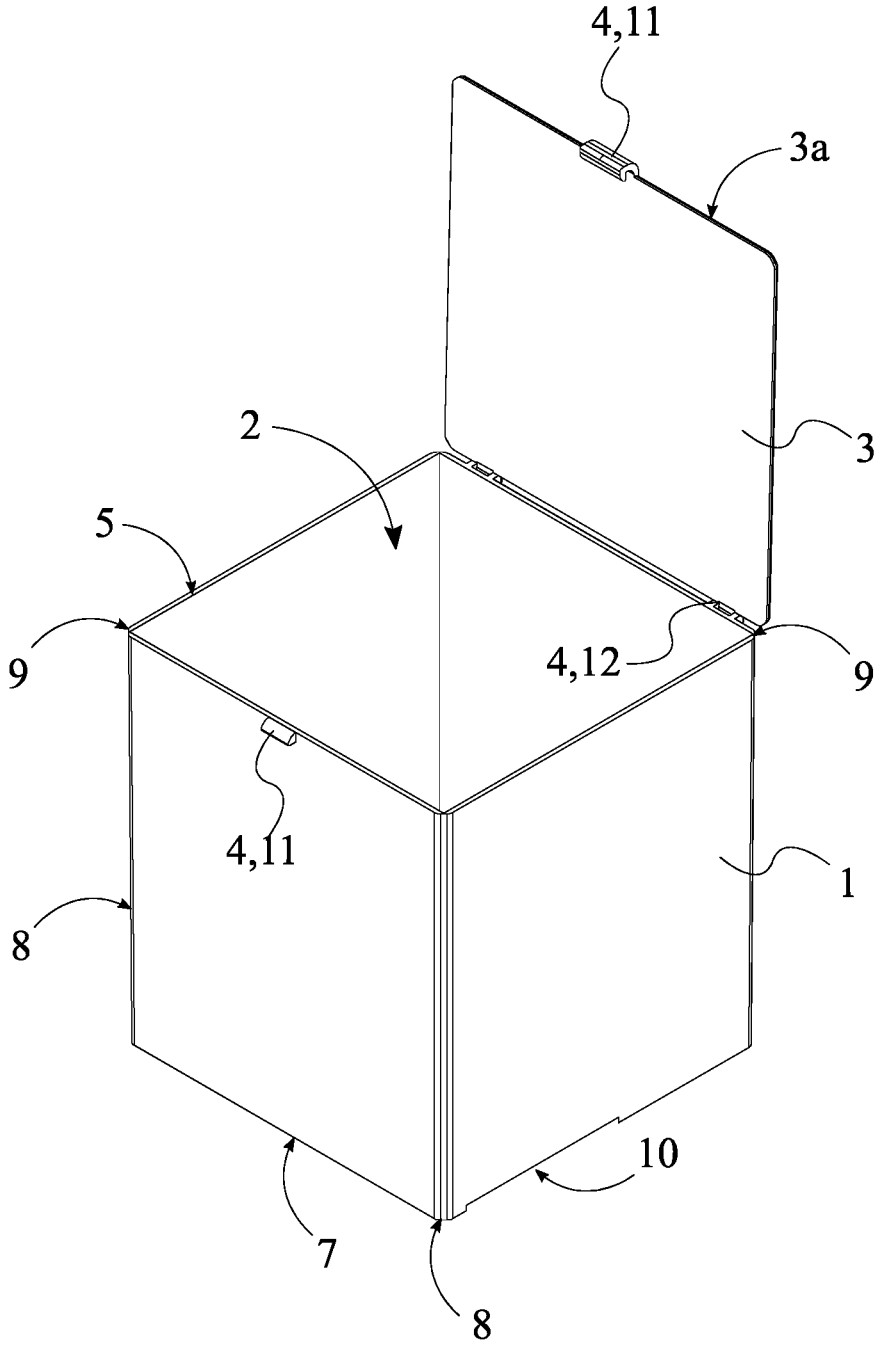
FIG. 1 is a top-front-left perspective view of the present invention, wherein the lid is open.

All illustrations of the drawings are for the purpose of describing selected versions of the present invention and are not intended to limit the scope of the present invention.

In reference to FIG. 1 through FIG. 9, the present invention is a tissue box covering apparatus. An objective of the present design is to provide the user with a tissue box cover that prevents contaminants such as dust, bacteria, germs, droplets and viruses that may be spread by sneezing, coughing, talking of people and pets, from intruding into the box. Further, the present invention comprises a plurality of folding edges that enables a foldable configuration for the box cover, for ease of display, storage, packaging and transport. Furthermore, the lid of the present invention is removably attached, such that the lid may be removed when replacing the tissue box or when the box cover is stored in a folded configuration. The lid comprises a rim that sits flush against the opening of the cover to prevent both solids and liquids from entering and contaminating the tissues. Additionally, a plurality of fasteners mounted between the lid and the box cover provides a secure covering for the tissue box, as well as enables users to easily fasten and unfasten the lid to the box cover.

The following description is in reference to FIG. 1 through FIG. 9. According to a preferred embodiment, the tissue box covering apparatus comprises a receptacle 1, an inner cavity 2, a lid 3, and a plurality of fasteners 4. The receptacle 1 may comprise any material or combination thereof but is preferably constructed of a plastic that allows for a malleable connection between each surface of the walls of the receptacle 1. Further, the receptacle 1 is cubical in shape, such that a regular cubical tissue box may be placed within the receptacle 1. However, the receptacle 1 may comprise any other size, shape, material, components, arrangement of components etc., as long as the intents of the present invention are not altered. In order to house the tissue box within the receptacle 1, the inner cavity 2 normally traverses into the receptacle 1. More specifically the inner cavity 2 traverses normally and centrally through the receptacle 1 proximate to the walls of the receptacle 1 in such a way that, the inner cavity 2 is big enough to contain the tissue box.

It is an aim of the present invention to protect tissues in a tissue box from external contaminants. To accomplish this, the lid 3 is detachably mounted onto a first end 5 of the receptacle 1, and the plurality of fasteners 4 is perimetrically mounted between the lid 3 and the first end 5 of the receptacle 1. This arrangement is so that, the lid 3 covers the inner cavity 2 when the plurality of fasteners 4 is fastened. Preferably, the lid 3 is a square in shape and fits around the edges of the first end 5 of the receptacle 1 in a snug fashion. However, the lid 3 may comprise any other shape, size, dimension etc., as long as the intents of the present invention are not altered.

Figure 2:
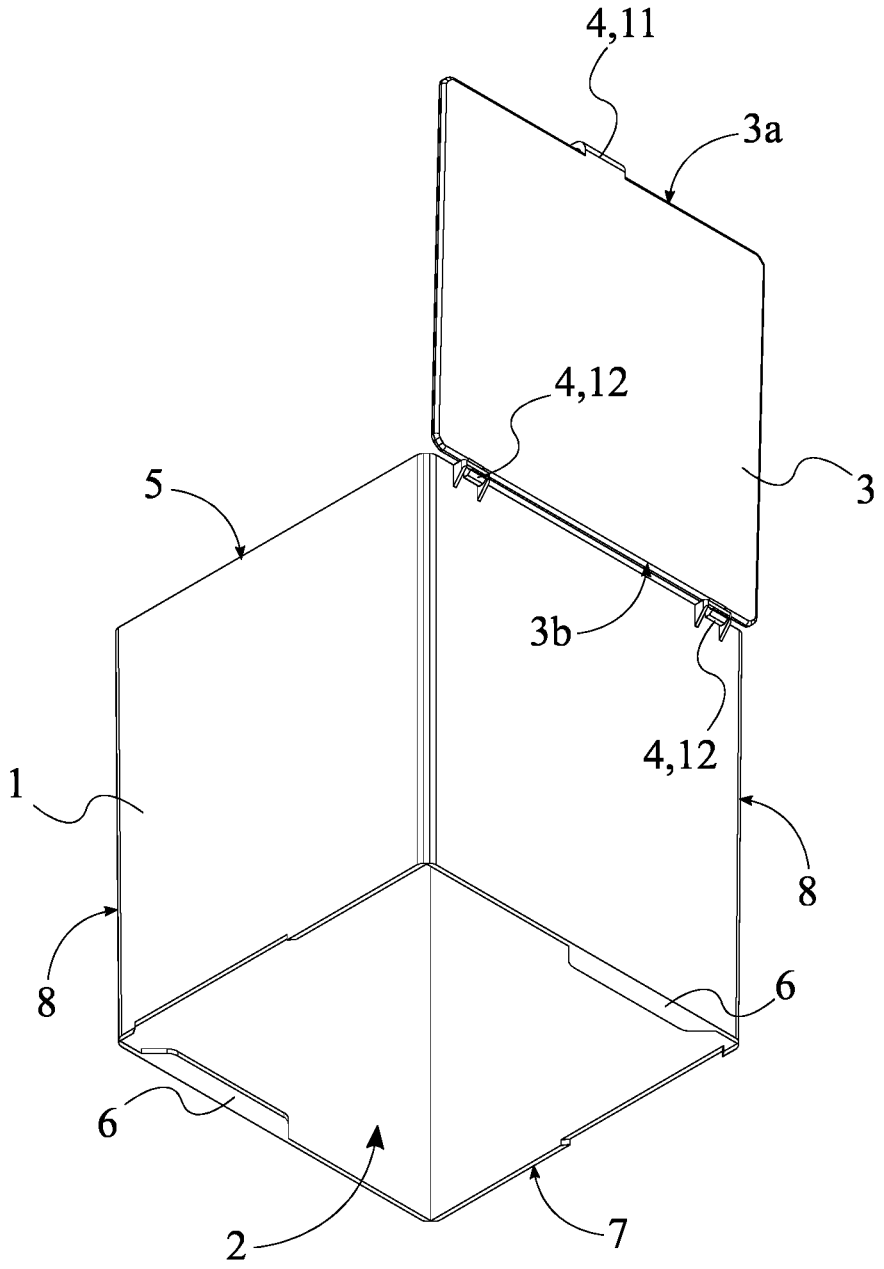
FIG. 2 is a bottom-rear-left perspective view of the present invention, wherein the lid is open.
Figure 6:
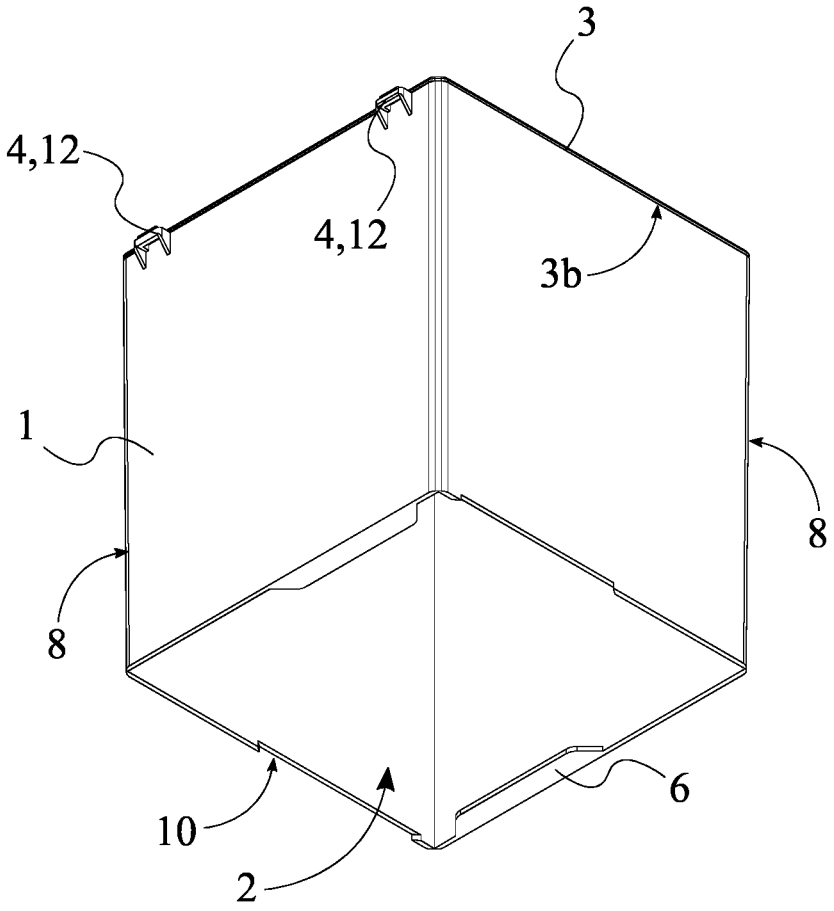
FIG. 6 is a bottom-rear-right perspective view of the present invention, wherein the lid is closed.
Figure 7:
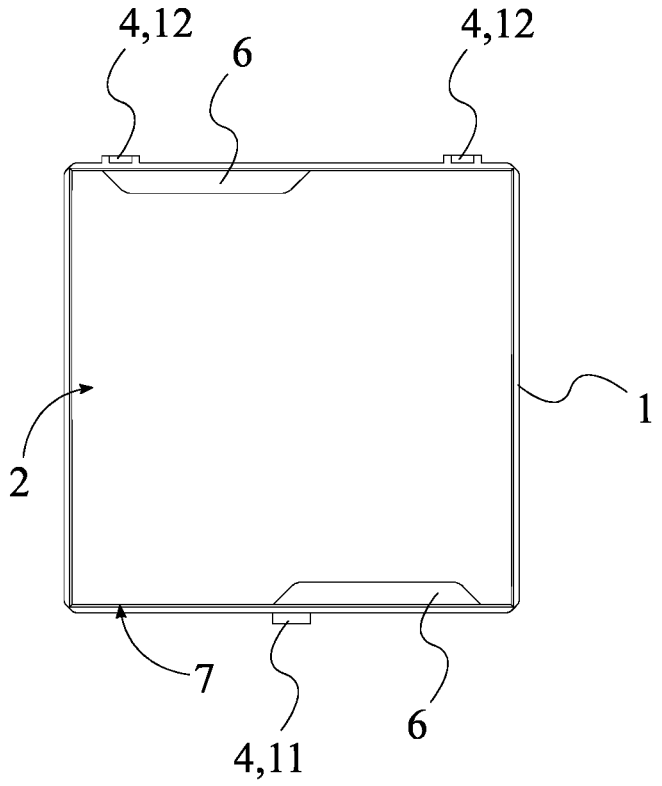
FIG. 7 is bottom plan view of the present invention.
Figure 8:
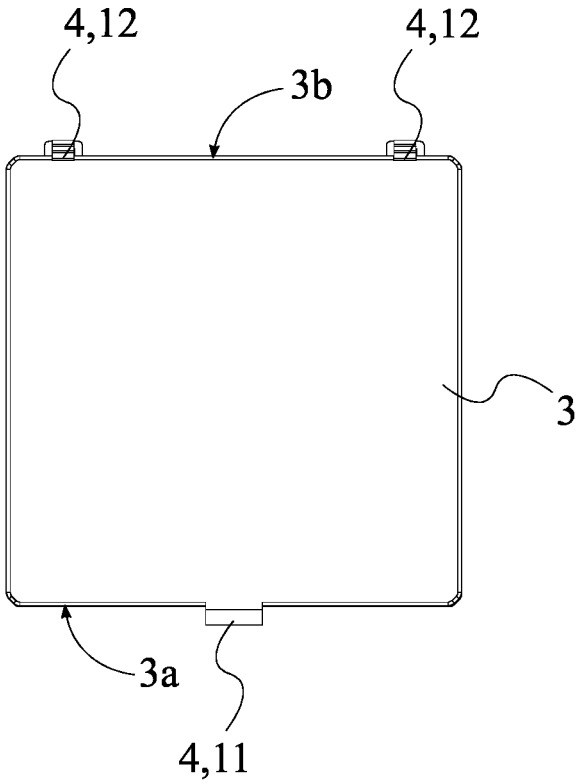
FIG. 8 is a top plan view of the present invention, wherein the lid is closed.

In order to hold the tissue box within the inner cavity 2 and make sure the tissue box does not fall off through the inner cavity 2, the receptacle 1 comprises at least one tab 6. In the preferred embodiment, the at least one tab 6 is laterally mounted onto a second end 7 of the receptacle 1, wherein the second end 7 is positioned opposite to the first end 5 across the receptacle 1. To that end, the at least one tab 6 extends into the inner cavity 2, in such a way that the at least one tab 6 is coplanar to the second end 7 of the receptacle 1. As seen in FIG. 2 and FIG. 6, two tabs from opposing ends of the second end 7 protrudes towards the inner cavity 2, creating a ledge for the tissue box to rest on. Preferably, the at least one tab 6 is rectangular in shape and comprises rounded edges, such that the at least one tab 6 is safe to handle. However, the at least one tab 6 may comprise any other shape, size, dimension etc., as long as the intents of the present invention are not altered.

Figure 9:
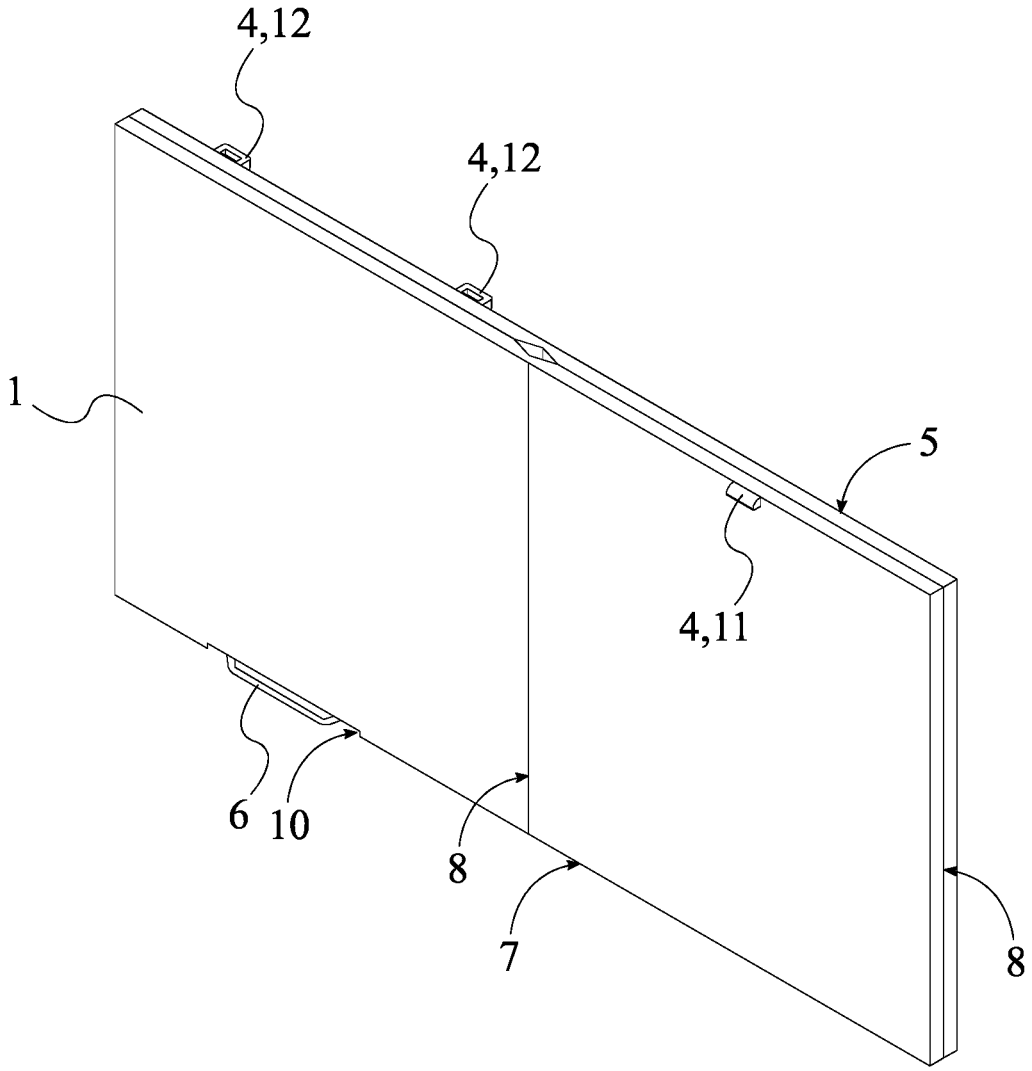
FIG. 9 is a top-front-left perspective view, wherein the box cover is in a collapsed configuration.

It is an aim of the present invention to fold the receptacle 1 for compact storage when not in use. The foldable configuration allows retailers to carry larger quantities of the product in store, reduce packaging cost and enables ease of display and transportation. To accomplish this, the receptacle 1 comprises a plurality of folding edges 8, wherein the plurality of folding edges 8 extends from the first end 5 towards the second end 7 of the receptacle 1. In other words, the receptacle 1 is foldable along the plurality of folding edges 8, wherein the plurality of folding edges 8 is positioned along a plurality of corners 9 of the receptacle 1. More specifically, each of the plurality of folding edges 8 correspond to each of the plurality of inner corners 9 as defined by the quadrilateral configuration of the receptacle 1. In other words, the plurality of folding edges 8 features a triangular shaped cutout that traverses each corner of the receptacle 1 from the first end 5 to the second end 7, such that the plurality of folding edges 8 allows inner surfaces of the receptacle 1 to hingedly attach to each other and allow for the folding of the receptacle into a flat body, as seen in FIG. 9. Further, the geometry of plurality of folding edges 8 and the foldability of the receptacle 1 allows for better packaging, storage and transportability after manufacture. However, the plurality of folding edges 8 may comprise any other configuration, folding mechanism, components and arrangement of components, as long as the objectives of the present invention are fulfilled.

As seen in FIG. 1 through FIG. 6, the present invention comprises at least one air gap 10. In the preferred embodiment, the at least one air gap 10 laterally traverses into the receptacle 1, and the at least one air gap 10 is positioned adjacent the second end 7 of the receptacle 1. This is so that the at least one air gap 10 provides an access way for air and prevents the tissue box from being stuck within the inner cavity 2 even when the lid is in the closed configuration.

Figure 3:
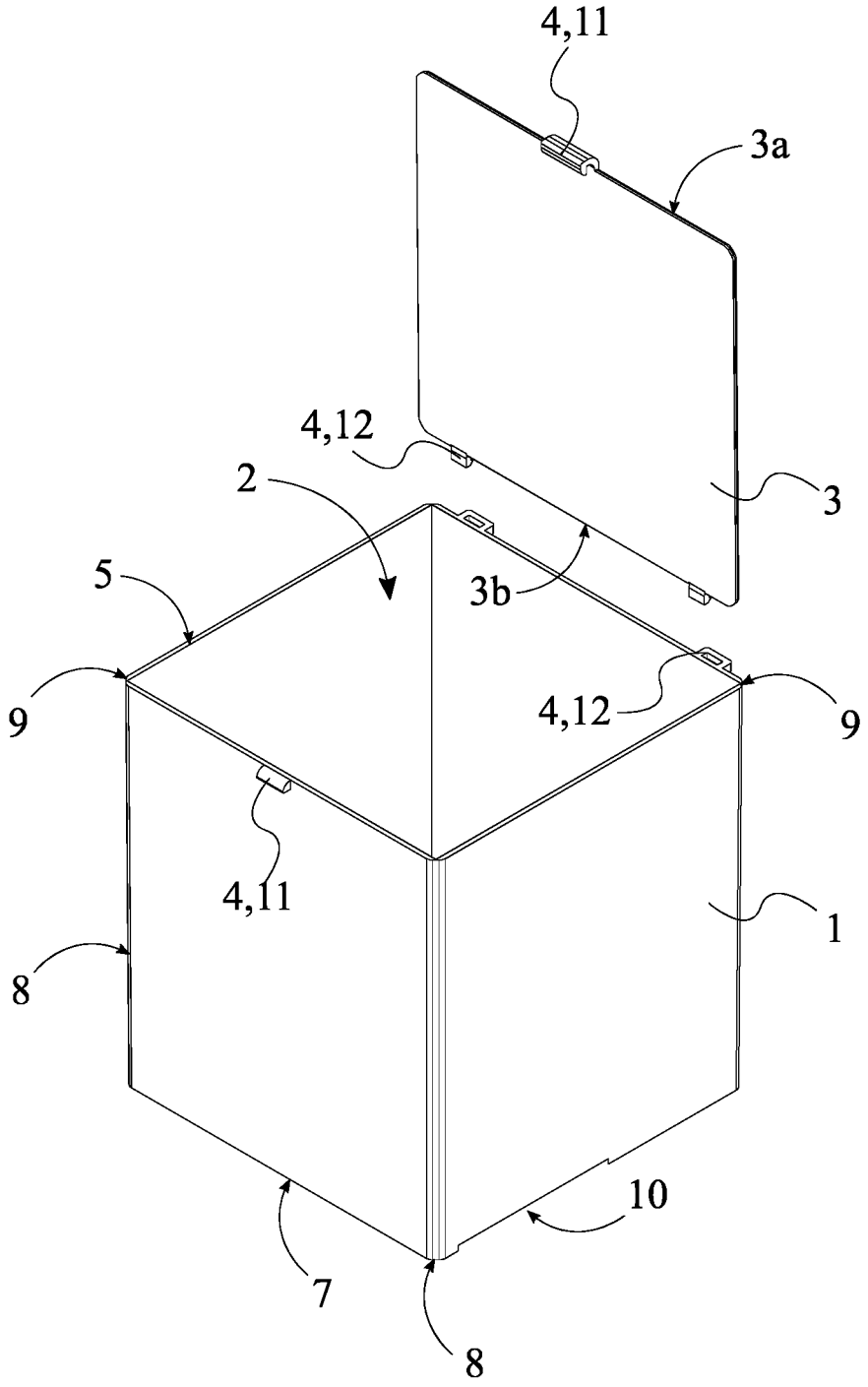
FIG. 3 is a top-front-left perspective view of the present invention, wherein the lid is completely detached from the box cover.
Figure 4:
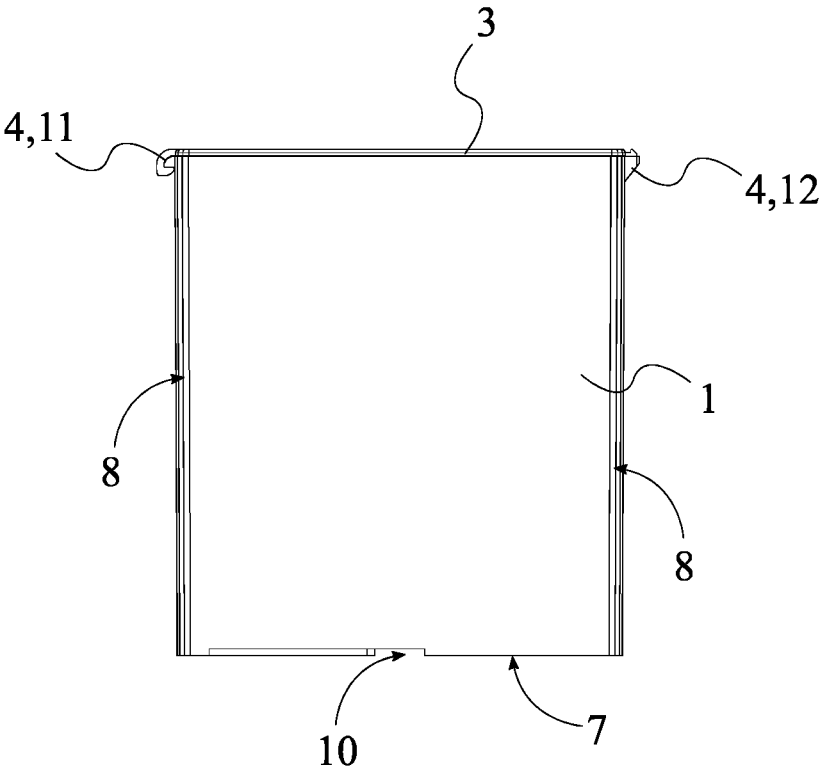
FIG. 4 is a left side elevational view of the present invention, wherein the lid is closed.
Figure 5:
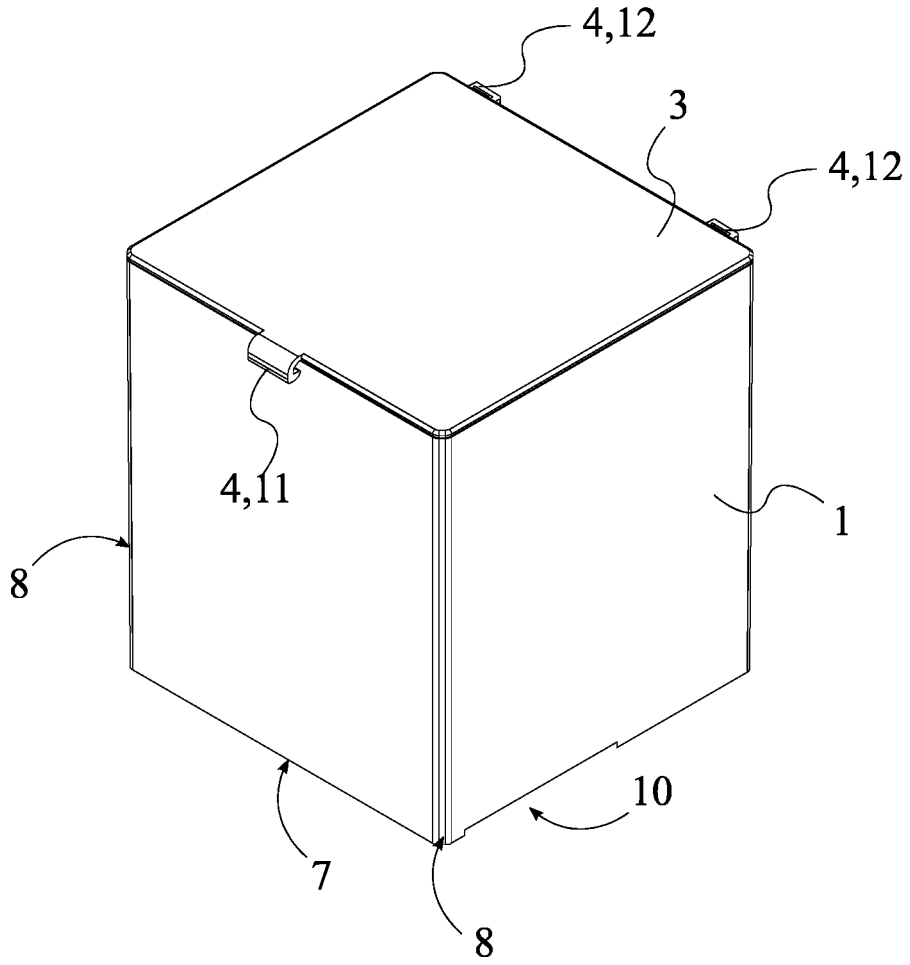
FIG. 5 is a top-front-left perspective view of the present invention, wherein the lid is closed.

According to the preferred embodiment of the present invention, the plurality of fasteners 4 comprises a first fastener 11, and at least one second fastener 12. Preferably, the first fastener 11 is mounted between a first edge 3*a* of the lid 3 and the first end 5 of the receptacle 1, and the at least one second fastener 12 is mounted between a second edge 3*b* of the lid 3 and the first end 5 of the receptacle 1, wherein the first edge 3*a* is positioned opposite to the second edge 3*b* across the lid 3. As seen in FIG. 1, and FIG. 5, the at least one second fastener 12 is hingedly connected between the first end 5 of the receptacle 1 and the second edge 3*b* of the lid. This arrangement of the second fastener 12 enables the lid 3 to be angularly offset from the receptacle 1 along the second edge 3*b*, such that the lid 3 may be opened and closed as seen in FIG. 1 and FIG. 5, respectively. Further, the lid 3 may be completely removed from the receptacle 1 as seen in FIG. 3, for easy storage and transportation, while the receptacle 1 is folded along the plurality of folded edges 8. Preferably, the first fastener 11 and the at least one second fastener 12 comprise snap-on fasteners. However, the first fastener 11 and the at least one second fastener 12 may comprise any other fastener or fastening techniques that are known to one of ordinary skill in the art, as long as the intents of the present invention are not altered. Examples of such fasteners include, but are not limited to snap buttons, magnetic, hook and loop, zipper, etc.

Thus, the present invention, provides ease of transportation for the tissue box while still being protected and supported from all six sides.

Although the invention has been explained in relation to its preferred embodiment, it is to be understood that many other possible modifications and variations can be made without departing from the spirit and scope of the invention as hereinafter claimed.

What is claimed is:

1. A collapsible tissue box covering apparatus, configured in a first configuration to cover a tissue box, and in a collapsed configuration to collapse into a flat body, said tissue box comprising in at least one configuration:

a receptacle having only four collapsible sides comprising a first side, a second side, a third side, and a fourth side formable into an upright structure configured to receive the tissue box;

an inner cavity normally traversing into the receptacle;

a lid wherein the lid is completely detachably mounted to a top surface of the receptacle wherein the lid is completely removable to expose the inner cavity from the top surface of the receptacle;

a plurality of fasteners;

a first tab and a second tab laterally mounted on separate sides of the four collapsible sides, wherein the first tab and the second tab are positioned on opposite sides of each other on an underside of the receptacle and wherein the first tab and the second tab protrude into the inner cavity of the receptacle, wherein the collapsible tissue box covering apparatus does not include a bottom panel;

the plurality of fasteners being perimetrically mounted between the lid and a first end of the receptacle; and said collapsible tissue box covering apparatus configured in said first configuration to fold to cover said tissue box, and in said collapsed configuration to fold into a flat body for any of display, storage, and transport.

2. The collapsible tissue box covering apparatus of claim 1, wherein in said first configuration of the receptacle being cubical.

3. The collapsible tissue box covering apparatus of claim 1, wherein in said first configuration, the lid covers the inner cavity over the top surface of the receptacle, when the plurality of fasteners is fastened.

4. The collapsible tissue box covering apparatus of claim 1, the receptacle comprising in at least said first configuration:

a plurality of folding edges;

the plurality of folding edges extending from the first end towards a second end of the receptacle; and the receptacle being foldable along the plurality of folding edges.

5. The collapsible tissue box covering apparatus of claim 4, wherein in at least said first configuration, the plurality of folding edges being positioned along a plurality of corners of the receptacle.

6. The collapsible tissue box covering apparatus of claim 1, wherein in at least said first configuration, the inner cavity traverses centrally through the receptacle.

7. The collapsible tissue box covering apparatus of claim 1, comprising in at least said first configuration:

at least one air gap;

the at least one air gap laterally traversing into the receptacle; and the at least one air gap being positioned adjacent a second end of the receptacle.

8. The collapsible tissue box covering apparatus of claim 1, the plurality of fasteners comprising in at least said first configuration:

a first fastener;

at least one second fastener;

the first fastener being mounted between a first edge of the lid and the first end of the receptacle; and the at least one second fastener being mounted between a second edge of the lid and the first end of the receptacle, wherein the first edge is positioned opposite to the second edge across the lid.

9. The collapsible tissue box covering apparatus of claim 8, wherein in at least said first configuration, the at least one second fastener being removeably hingedly connected between the first end of the receptacle and the second edge of the lid.

10. The collapsible tissue box covering apparatus of claim 8, wherein the first fastener and the at least one second fastener comprise snap-on fasteners.

11. The collapsible tissue box covering apparatus of claim 1, wherein in at least said first configuration, the at least one tab being coplanar to the second end of the receptacle.

12. The collapsible tissue box covering apparatus of claim 1, wherein the at least one tab comprising round edges.

13. The collapsible tissue box covering apparatus of claim 1, wherein the lid being a square in shape.

14. A collapsible tissue box covering apparatus, configured in a first configuration to cover a tissue box, and in a collapsed configuration to collapse into a flat body, said collapsible tissue box covering apparatus comprising in at least one configuration:

a receptacle having only four collapsible sides comprising a first side, a second side, a third side, and a fourth side formable into an upright structure configured to receive the tissue box;

an inner cavity, the inner cavity normally traversing into the receptacle;

a lid wherein the lid is completely detachably mounted to a top surface of the receptacle wherein the lid is completely removable to expose the inner cavity from the top surface of the receptacle;

a first tab and a second tab laterally mounted on separate sides of the four collapsible sides, wherein the first tab and the second tab are positioned on opposite sides of each other on an underside of the receptacle and wherein the first tab and the second tab protrude into the inner cavity of the receptacle, wherein the collapsible tissue box does not include a bottom panel;

a plurality of fasteners, the plurality of fasteners being perimetrically mounted between the lid and the first end of the receptacle;

a plurality of folding edges, the plurality of folding edges extending from the first end towards the second end of the receptacle; and the receptacle being foldable along the plurality of folding edges;

said collapsible tissue box covering apparatus configured in said first configuration to fold to cover said tissue box, and in said collapsed configuration to fold into a flat body for any of display, storage, and transport.

15. The collapsible tissue box covering apparatus of claim 14, wherein in said first configuration the receptacle being cubical.

16. The collapsible tissue box covering apparatus of claim 14, wherein in said first configuration, the lid covers the inner cavity, when the plurality of fasteners is fastened.

17. The collapsible tissue box covering apparatus of claim 14, wherein in at least said first configuration, the plurality of folding edges being positioned along a plurality of corners of the receptacle.

18. The collapsible tissue box covering apparatus of claim 14, comprising, in at least said first configuration:

at least one air gap;

the at least one air gap laterally traversing into the receptacle; and the at least one air gap being positioned adjacent the second end of the receptacle.

19. The collapsible tissue box covering apparatus of claim 14, the plurality of fasteners comprising:

a first fastener;

at least one second fastener;

the first fastener being mounted between a first edge of the lid and the first end of the receptacle; and the at least one second fastener being mounted between a second edge of the lid and the first end of the receptacle, wherein the first edge is positioned opposite to the second edge across the lid.

20. The collapsible tissue box covering apparatus of claim 19, wherein in at least said first configuration, the at least one second fastener being removeably hingedly connected between the first end of the receptacle and the second edge of the lid.

* * * * *